US006402124B1

(12) United States Patent
Pattullo et al.

(10) Patent No.: US 6,402,124 B1
(45) Date of Patent: Jun. 11, 2002

(54) CARBURETOR FUEL MIXTURE ADJUSTMENT ASSEMBLY

(75) Inventors: George M. Pattullo, Caro; Donald C. Ross; David L. Speirs, both of Cass City, all of MI (US)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 09/538,123

(22) Filed: Mar. 29, 2000

(51) Int. Cl.[7] ..... F02M 3/08

(52) U.S. Cl. ..... 261/71; 137/382; 251/227; 261/DIG. 38; 261/DIG. 84

(58) Field of Search ..... 261/71, DIG. 38, 261/DIG. 84, DIG. 39; 137/382; 251/227

(56) References Cited

U.S. PATENT DOCUMENTS

| | | | | | |
|---|---|---|---|---|---|
| 3,469,825 | A | * | 9/1969 | Du Bois | 261/71 |
| 4,097,561 | A | * | 6/1978 | Seki et al. | 261/DIG. 38 |
| 4,271,093 | A | | 6/1981 | Kobayashi | 261/DIG. 68 |
| 4,283,353 | A | * | 8/1981 | Miller | 261/71 X |
| 4,568,499 | A | * | 2/1986 | Wood | 261/DIG. 38 |
| 5,262,092 | A | | 11/1993 | Reeder et al. | 261/35 |
| 5,707,561 | A | * | 1/1998 | Swanson | 261/71 |
| 5,753,148 | A | * | 5/1998 | King et al. | 261/71 |
| 6,003,845 | A | * | 12/1999 | Kus | 261/71 X |

FOREIGN PATENT DOCUMENTS

| | | |
|---|---|---|
| JP | 7-346529 | 6/1997 |

* cited by examiner

*Primary Examiner*—Richard L. Chiesa
(74) *Attorney, Agent, or Firm*—Reising, Ethington, Barnes, Kisselle, Learman & McCulloch, PC

(57) ABSTRACT

A carburetor fuel mixture adjustment assembly including a threaded cylindrical needle valve receptacle formed in a carburetor main body and intersecting a fuel passage. A needle valve body is threaded into the needle valve receptacle and includes a needle that extends into an axially-aligned needle seat orifice portion of the fuel passage. The needle is axially movable within the needle seat orifice by rotation of the needle valve body to control how much of the orifice is open to fuel flow. A valve spring disposed between a head of the needle valve body and the carburetor main body biases the head away from the carburetor main body. A needle stabilizer engages and cooperates with the valve spring in laterally biasing the needle into one position relative to the needle seat orifice. The lateral bias assures constant fuel flow through the orifice by resisting needle movement.

18 Claims, 2 Drawing Sheets

CARBURETOR FUEL MIXTURE ADJUSTMENT ASSEMBLY

TECHNICAL FIELD

This invention relates generally to a carburetor fuel mixture adjustment assembly for adjusting the air-fuel ratio of a fuel mixture to be supplied to an engine.

BACKGROUND OF THE INVENTION

It is known for a carburetor fuel mixture adjustment assembly to include a needle valve body that is threaded into a needle valve receptacle in a carburetor main body. The valve receptacle in such an assembly intersects a fuel passage in the carburetor main body. The needle valve body generally includes an exteriorly threaded portion, a needle and a shank portion disposed between the threaded portion and the needle. The threaded portion of the valve body engages a threaded portion of the needle valve receptacle. The needle of the valve body is positioned within an axially-aligned needle seat orifice of the fuel passage and can be axially advanced and retracted, by rotation of the needle valve body within the needle valve receptacle, to adjust fuel mixture. Axial advancement and retraction of the needle within the needle seat orifice respectively decreases and increases the amount of fuel that can flow through the orifice by decreasing and increasing the cross-sectional area of the valve restriction through the needle seat orifice. The needle valve body is rotated by using a tool such as a screwdriver to engage a screw head of the valve body that protrudes from the carburetor main body. In some such assemblies, to prevent inadvertent or uncommanded rotation of the valve body within the valve body receptacle, a tamper-resistant adjustment needle limiter cap is placed over the screw head and is secured to or braced against an adjacent structure.

Fuel mixture adjustment assemblies of this type include enough clearance between the respective threaded portions of the needle valve body and the valve body receptacle to allow for lateral movement of the needle within the needle seat orifice when force is applied to the valve body head. This lateral movement can change the size of the orifice enough to result in fuel flow rate changes of up to 20% from an optimum fuel flow rate determined by the manufacturer. Fuel flow rate changes caused by needle "slop" result in excessively rich or lean fuel mixtures that undesirably increase exhaust emissions. Therefore, it is desirable to reduce fuel flow fluctuations through the needle valve and the resulting increase in exhaust emissions by limiting needle slop.

One example of a stabilizing system for a fuel mixture adjustment needle is disclosed in Japanese Patent Application No. 7-346529 filed Dec. 12, 1995 (Japanese Laid-open Publication No. 9-158783 published Jun. 17, 1997). The Japanese Patent Application describes a carburetor fuel mixture adjustment assembly as described above and including a pressure plate made of an elastic material and overlaid on an outer surface of the carburetor main body. The pressure plate includes an aperture that a protruding portion of the needle valve body must be inserted through during assembly. The presence of the pressure plate limits movement of the needle valve body within the needle valve receptacle by holding the needle valve body in a centered position. The carburetor fuel mixture adjustment assembly disclosed in the Japanese Patent Application also includes an annular sealing member coaxially disposed between the shank portion of the needle valve body and the needle valve receptacle such that the sealing member is compressed between the receptacle and the shank to prevent air from passing between the receptacle and valve body and leaking into the fuel passage. The sealing member is essentially an elongated tube of constant inner and outer diameter that must be forced over a shank portion of the needle valve body then forced into a section of the receptacle shaped to receive the sealing member during assembly. To produce an effective seal against air leakage into the carburetor, machining tolerances must be tight for inner and outer circumferential surfaces of the sealing member, an outer circumferential surface of the shank portion of the valve body, and an inner circumferential surface of the portion of the receptacle receiving the sealing member.

SUMMARY OF THE INVENTION

A carburetor fuel mixture adjustment assembly is provided for adjusting the air-fuel ratio of a fuel mixture to be supplied to an engine. The assembly includes an interiorly threaded cylindrical needle valve receptacle formed in a carburetor main body. The valve receptacle intersects a fuel passage formed in the carburetor main body. A needle valve body is supported within the needle valve receptacle. The needle valve body includes an exteriorly threaded portion, a needle and a shank portion disposed between the threaded portion and the needle. The threaded portion of the valve body is in threaded engagement with the needle valve receptacle. The needle is disposable within an axially aligned needle seat orifice portion of the fuel passage. The needle is axially advanceable and retractable by rotation of the needle valve body within the needle valve body receptacle. The needle is movable to positions within the needle seat orifice that respectively decrease and increase the size of a portion of the orifice that is open to fuel flow. The carburetor fuel mixture adjustment assembly also includes a valve spring that is concentrically disposed around the needle valve body between a head of the needle valve body and the carburetor main body. The valve spring is supported in a position biasing the head axially away from the carburetor main body.

The carburetor fuel mixture adjustment assembly also includes a needle stabilizer that engages and cooperates with the valve spring in laterally biasing the needle into one position relative to the needle seat orifice. The lateral bias assures constant fuel flow through the orifice by resisting needle displacement due to such factors as engine vibration and installation of a tamper-resistant limiter cap on an outer end of the needle.

Objects, features and advantages of this invention include a needle stabilizer having a ramped surface that maintains a constant fuel mixture by cooperating with the spring in biasing the needle into the one position, a ramped spring seat that biases the spring against the needle valve body which biases the needle valve body against a side of the valve body receptacle, a spring seat having an easy-to-install horseshoe shape that can be slid between the spring and the carburetor main body, a spring seat integrally formed with a carburetor main body to eliminate an assembly step, a spring that includes the ramped surface, an annular wedge ring that biases the needle valve to a centered position within the valve body receptacle, a sealing member that stabilizes the needle and prevents ambient air from leaking past the needle valve body, a sealing member having an easy to install conical shape that includes independent annular expansion and compression regions that provide a seal between the valve body and valve body receptacle despite rough machining tolerances and any concentricity mismatch between shank and receptacle, and a sealing member compression region that has an outer circumferential contact area greater than an inner contact area of the annular expansion region to insure that the sealing member stays in place when the needle shank is backed out of the seat.

BRIEF DESCRIPTION OF THE DRAWINGS

These and other objects, features and advantages of the invention will become apparent from the following detailed description of the preferred embodiment(s) and best mode, appended claims, and accompanying drawings in which:

DETAILED DESCRIPTION

Figure 1:
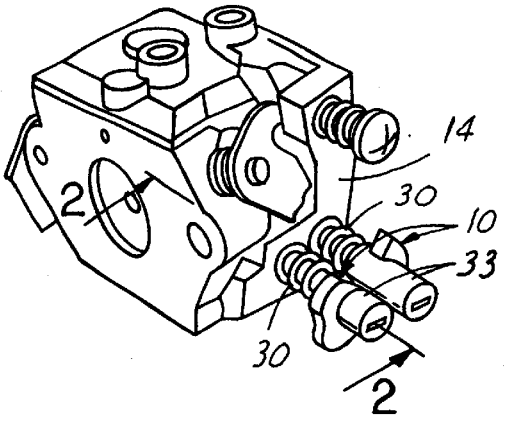
FIG. 1 is a perspective view of a carburetor including a fuel mixture adjustment assembly constructed according to a first embodiment of the invention.

A carburetor fuel mixture adjustment assembly for adjusting the air-fuel ratio of a fuel mixture to be supplied to an engine is shown at 10 in FIGS. 1–4. Alternative embodiments of the carburetor fuel mixture adjustment assembly are generally indicated as 10*a*, 10*b* and 10*c* in FIGS. 7, 8 and 9, respectively. Reference numerals with a suffix "a" in FIG. 7, the suffix "b" in FIG. 8 and the suffix "c" in FIG. 9 designate the alternative configurations of each element common to the embodiment of FIGS. 1–4. Unless the following description indicates otherwise, where the description uses a reference numeral referring to an element in FIGS. 1–4, that portion of the description applies equally to elements in FIGS. 7–9 indicated by the same reference numeral but including the suffix "a". "b" and "c", respectively.

Figure 2:
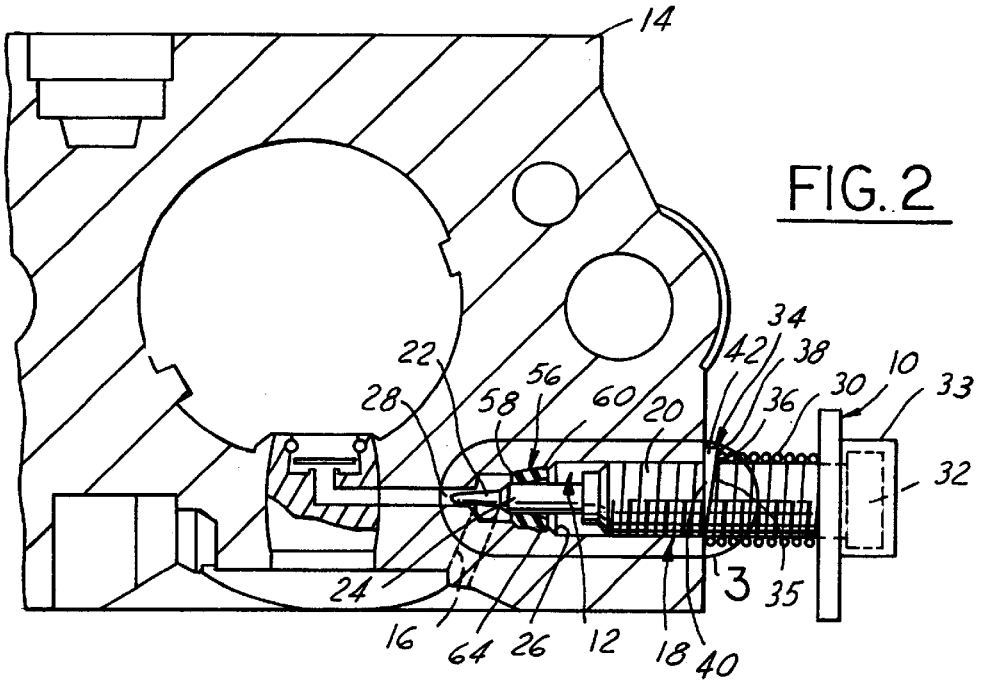
FIG. 2 is a fragmentary partial cross-sectional side view of the carburetor and assembly of FIG. 1 taken along line 2—2 of FIG. 1.
Figure 3:
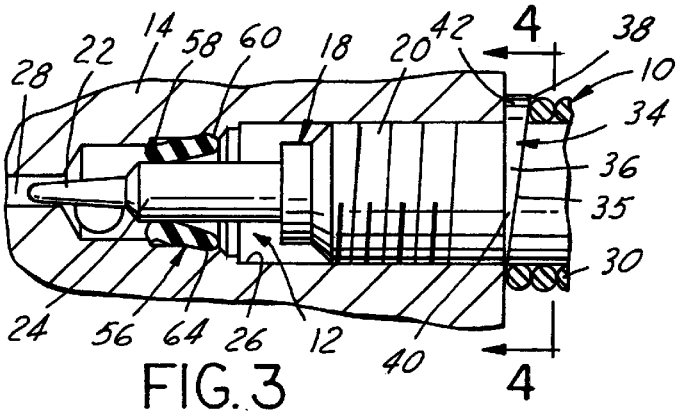
FIG. 3 is a magnified partial cross-sectional side view of a portion of the assembly of FIG. 1 bounded by line 3 of FIG. 2.

The assembly 10 includes an interiorly threaded generally cylindrical needle valve body receptacle 12 formed in a carburetor main body 14 as shown in FIGS. 2 and 3. The valve body receptacle 12 intersects a fuel passage 16 formed in the carburetor main body 14. A generally cylindrical elongated needle valve body 18 is concentrically supported within the needle valve body receptacle 12. The needle valve body 18 includes an exteriorly threaded portion 20, a needle 22 and a shank portion 24. The shank portion 24 is integrally disposed between the threaded portion 20 and the needle 22. The threaded portion 20 of the valve body 18 is in threaded engagement with an interiorly threaded portion 26 of the needle valve body receptacle 12. The needle 22 is disposable within an axially aligned needle seat orifice portion 28 of the fuel passage 16. The needle 22 is axially advancable and retractable by rotation of the needle valve body 18 within the needle valve body receptacle 12. The needle 22 must thus be advanced to various axial positions within the needle seat orifice 28 to change the size of the portion of the orifice 28 that is open to fuel flow. The farther the needle 22 is advanced into the needle seat orifice 28, the less the cross sectional area of an annular opening formed between the needle 22 and needle seat orifice 28 and the less fuel that can flow through the orifice 28 at a given pressure. The assembly 10 also includes a valve spring 30 that is concentrically disposed around the needle valve body 18 between a head 32 of the needle valve body 18 and the carburetor main body 14 in a position that allows the spring 30 to axially bias the head 32 away from the carburetor main body 14 as best shown in FIG. 2. The assembly 10 also includes a needle stabilizer 34 that engages and cooperates with the valve spring 30 and laterally biasing the needle 22 into one position relative to the needle seat orifice 28. The lateral bias assures that a constant fuel flow can be maintained through the orifice 28 because the lateral bias resists forces that would otherwise move the needle valve body 18 and change the position of the needle 22 within the needle seat orifice 28. Examples of external forces that can cause such movement include engine vibration and lateral forces applied during installation of a tamper-resistant limiter cap 33 over the head 32 of the needle 22.

Figure 4:
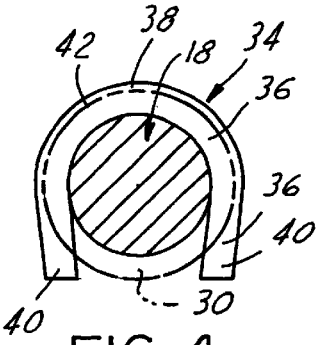
FIG. 4 is a cross-sectional end view of the assembly of FIG. 1 taken along line 4—4 of FIG. 3.

The needle stabilizer 34 includes a ramped surface 35 that cooperates with the spring 30 in biasing the needle 22 into the one position. The ramped surface 35 is disposed on a generally horseshoe-shaped spring seat shown at 36 in FIGS. 6–4. The spring seat 36 is disposed between the valve spring 30 and the carburetor main body 14 in a position that biases the spring 30 laterally, causing the spring 30 to tip or lean against the needle valve body 18. The resulting side load exerted by the spring 30 on the needle valve body 18 biases the needle valve body 18 laterally against a side of the valve body receptacle 12 opposite an axially outermost portion 38 of the ramped needle stabilizer surface 36. As best shown in FIG. 4, the spring seat 36 includes a pair of legs 40 and an arcuate portion 42 that integrally connects the legs 40. The axially outermost portion 38 of the ramp needle stabilizer surface 36 is disposed on the arcuate portion 42 of the spring seat 36. The horseshoe shape of the spring seat 36 allows an installer to easily slide the spring seat 36 between the spring 30 and the carburetor main body 14 such that the legs 40 bracket the needle valve body 18. In other embodiments, the spring seat 36, rather than being a separate piece, may be integrally formed with or connected to the carburetor main body 14.

Figure 7:
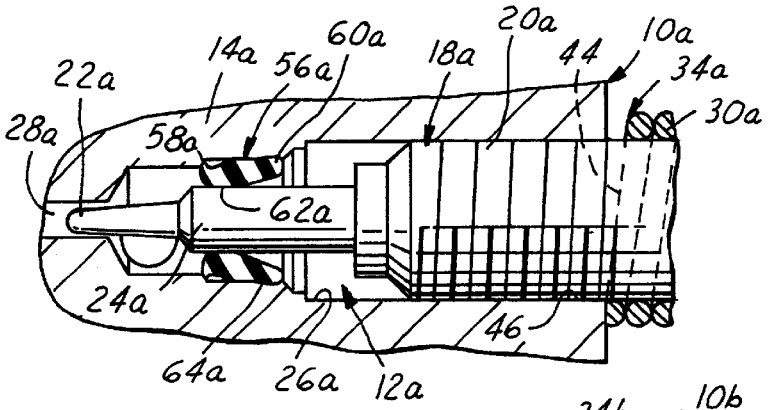
FIG. 7 is a partial cross-sectional side view of a fuel mixture adjustment assembly constructed according to a second embodiment of the invention.

According to a first alternative embodiment of the assembly 10 shown at 10*a* in FIG. 7, a spring 30*a* is formed to include the needle stabilizer 34*a*. More specifically, the end of the spring 30*a* abutting the carburetor main body 14*a* is formed to include a ramped surface 44 that biases or tips the spring 30*a* against the needle valve body 18*a*. Resulting lateral pressure on the needle valve body 18*a* causes the needle valve body 18*a* to be biased against a wall 46 of the valve body receptacle 12. As with the embodiment of FIGS. 1–4, this stabilizes the needle 22*a* in a single offset position within the needle seat orifice 28*a*.

Figure 8:
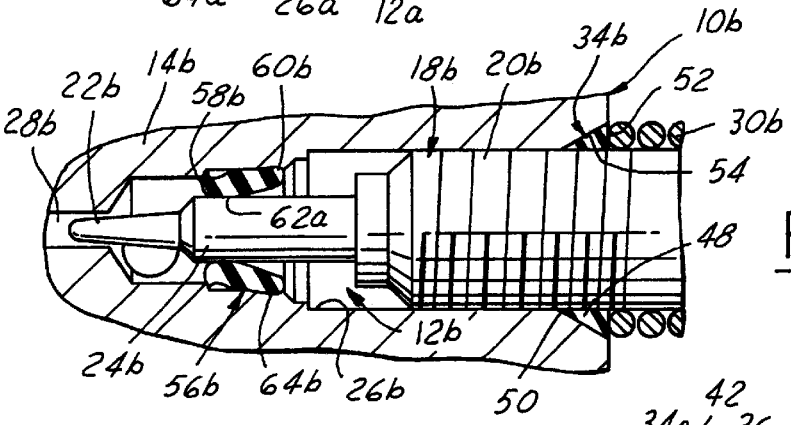
FIG. 8 is a partial cross-sectional side view of a fuel mixture adjustment assembly constructed according to a third embodiment of the invention.

According to a second alternative embodiment of the assembly shown at 10*b* in FIG. 8, the needle stabilizer 34*b* includes at least one wedge 48 having an axially inwardly directed leading edge 50 that is engaged between the needle valve body 18*b* and the valve body receptacle 12*b*. A bearing surface 52 of the wedge 48 is disposed axially opposite the leading edge 50 and operatively engages the spring 30*b* allowing the spring 30*b* to bias the wedge 48 axially inward. The wedge 48 has annular plan form and is concentrically disposed around the needle valve body 18*b*. Because the wedge 48 has an annular ring shape, when the spring 30*b* drives it axially inward, the wedge 48 tends to bias the needle valve body 18*b* to a centered position within the valve body receptacle 12*b*. The wedge, or annular "wedge ring" 48, is received in a complimentary-shaped wedge ring receptacle 54 formed in a carburetor main body 14*b*. The wedge ring receptacle 54 helps to convert axially-directed spring forces into radially-inwardly directed biasing forces that act on the valve body 18*b* to maintain the needle valve body 18*b* in a centered position.

Figure 9:
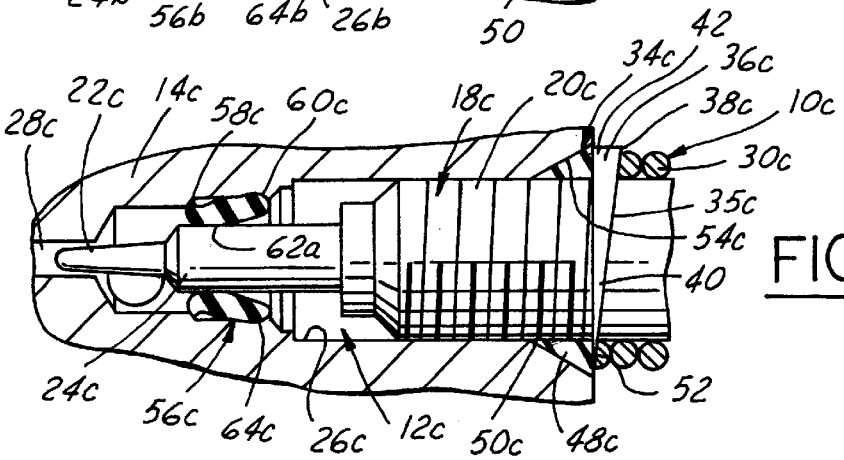
FIG. 9 is a partial cross-sectional side view of a fuel mixture adjustment assembly constructed according to a fourth embodiment of the invention.

As shown in FIG. 9, a third alternative embodiment of the assembly includes a wedge ring 48*c*, a wedge ring receptacle 54*c* and a spring seat 36*c* having a ramped surface 35*c*. The wedge ring 48*c* and spring seat 36*c* cooperate to stabilize the position of the valve body 18*c* and the valve body receptacle 12*c* by respectively imposing centering forces and lateral biasing force on the valve body 18*c* at the same time.

Figure 5:
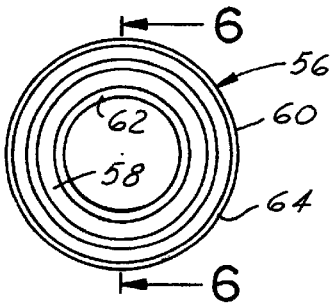
FIG. 5 is an end view of a sealing member of the assembly of FIG. 1.
Figure 6:
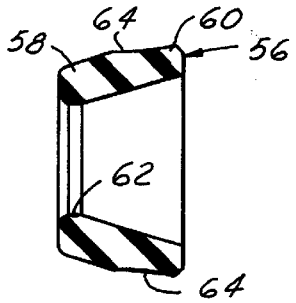
FIG. 6 is a cross-sectional side view of the sealing member of FIG. 5 taken along line 6—6 of FIG. 5.

In each of the above embodiments, an annular sealing member, preferably formed of a thermoplastic polymer such as acetal, is concentrically disposed between the shank portion 24 and the needle valve body 18 and the needle valve body receptacle 12. In other embodiments, the sealing member may be made of any suitable material such as rubber or metal. The sealing member, best shown at 56 in FIGS. 5 and 6, is compressed between the needle valve body receptacle 18 and the shank portion 24 of the needle valve body 18 to stabilize the needle 22 relative to the needle seat orifice 28 and to prevent ambient air from passing between the needle valve body 18 and the needle valve body receptacle 12. The annular sealing member 56 has an easy to install conical shape that includes independent annular expansion and compression regions 58, 60. The annular expansion and compression regions 58, 60 are disposed adjacent respective axially opposite ends of the sealing member 56 and are configured to engage the needle valve body 18 and the valve body receptacle 12 respectively. The expansion and compression regions 58, 60 are configured to provide a seal between the valve body 18 and the valve body receptacle 12 without requiring close machining tolerances on interfacing surfaces of the needle valve body 18, needle valve body receptacle 12, or the sealing member 56. The expansion and compression regions 58, 60 are also configured to compensate for any concentricity mismatch that might exist between the shank portion 24 of the needle valve body 18 and the valve body receptacle 12. In other words, particularly in assembly embodiments including a wedge ring or a similar structure that biases the needle valve body 18 laterally, the independent annular expansion and compression regions 58, 60 enable the sealing member 56 to provide an effective seal between the needle valve body 18 and the needle valve body receptacle 12 even when the needle valve body 18 is not concentrically disposed within the needle valve body receptacle 12.

The annular expansion region 58 of the sealing member 56 is disposed at an axial inner end of the sealing member 56 as is best shown in FIG. 6. The annular expansion region 58 is configured to expand slightly in a radially outward direction when installed around the shank portion 24 of the needle valve body 18. The annular compression region 60 is disposed at an axial outer end of the sealing member 56 opposite the inner end as is also best shown in FIG. 6. The annular compression region 60 is configured to compress radially inward when seated in the valve body receptacle 12.

The annular expansion region 58 of the sealing member 56 has an inner circumferential contact area 62 and the annular compression region 60 has an outer circumferential contact area 64 that is greater than the inner contact area of the expansion region 58. This insures that the sealing member 56 stays in place when the needle valve body shank portion is backed out of the valve body receptacle. The amount of interference between the shank and the annular expansion region of the sealing member 56 is calibrated to prevent excessive drag on the shank portion of the needle valve body 18.

This description is intended to illustrate certain embodiments of the invention rather than to limit the invention. Therefore, it uses descriptive rather than limiting words. Obviously, it's possible to modify this invention from what the description teaches. Within the scope of the claims, one may practice the invention other than as described.

We claim:

1. A carburetor fuel mixture adjustment assembly for adjusting the air-fuel ratio of a fuel mixture to be supplied to an engine, the assembly comprising:

an interiorly threaded cylindrical needle valve receptacle formed in a carburetor main body, the valve receptacle intersecting a fuel passage formed in the carburetor main body;

a needle valve body supported within the needle valve receptacle and including an exteriorly threaded portion, a needle and a shank portion disposed between the threaded portion and the needle, the threaded portion of the valve body being in threaded engagement with the needle valve receptacle, the needle being disposable within an axially-aligned needle seat orifice portion of the fuel passage and being axially advanceable and retractable, by rotation of the needle valve body within the needle valve body receptacle, to positions relative to the needle seat orifice to respectively decrease and increase the size of a portion of the orifice open to fuel flow;

a valve spring concentrically disposed around the needle valve body between a head of the needle valve body and the carburetor main body in a position biasing the head axially away from the carburetor main body; and a needle stabilizer comprising a ramped surface cooperating with the valve spring in laterally biasing the needle into one position relative to the needle seat orifice to assure constant fuel flow through the orifice by resisting needle displacement due to such factors as engine vibration and installation of a tamper-resistant limiter cap on an outer end of the needle.

2. A carburetor fuel mixture adjustment assembly for adjusting the air-fuel ratio of a fuel mixture to be supplied to an engine, the assembly comprising:

an interiorly threaded cylindrical needle valve receptacle formed in a carburetor main body, the valve receptacle intersecting a fuel passage formed in the carburetor main body;

a needle valve body supported within the needle valve receptacle and including an exteriorly threaded portion, a needle and a shank portion disposed between the threaded portion and the needle, the threaded portion of the valve body being in threaded engagement with the needle valve receptacle, the needle being disposable within an axially-aligned needle seat orifice portion of the fuel passage and being axially advanceable and retractable, by rotation of the needle valve body within the needle valve body receptacle, to positions relative to the needle seat orifice to respectively decrease and increase the size of a portion of the orifice open to fuel flow;

a valve spring concentrically disposed around the needle valve body between a head of the needle valve body and the carburetor main body in a position biasing the head axially away from the carburetor main body;

a needle stabilizer configured to engage and cooperate with the valve spring in laterally biasing the needle into one position relative to the needle seat orifice to assure constant fuel flow through the orifice by resisting needle displacement due to such factors as engine vibration and installation of a tamper-resistant limiter cap on an outer end of the needle; and the needle stabilizer comprises a ramped surface that cooperates with the spring in biasing the needle into the one position.

3. A carburetor fuel mixture adjustment assembly as defined in claim 2 in which the ramped surface is disposed on a spring seat disposed between the valve spring and the carburetor main body in a position biasing the spring against the needle valve body.

4. A carburetor fuel mixture adjustment assembly as defined in claim 3 in which the spring seat has a generally horseshoe-shaped planform including a pair of legs and an arcuate portion integrally connecting the legs, the axially outermost portion of the ramped needle stabilizer surface being disposed on the arcuate portion of the spring seat.

5. A carburetor fuel mixture adjustment assembly as defined in claim 3 in which the spring seat is integrally formed with the carburetor main body.

6. A carburetor fuel mixture adjustment assembly as defined in claim 2 in which the spring is formed to include the needle stabilizer.

7. A carburetor fuel mixture adjustment assembly as defined in claim 2 in which an annular sealing member is concentrically disposed between the shank portion of the needle valve body and the needle valve body receptacle and is compressed between the receptacle and the shank.

8. A carburetor fuel mixture adjustment assembly as defined in claim 7 in which the annular sealing member has a generally conical shape including independent annular expansion and compression regions disposed adjacent respective axially opposite ends of the sealing member and configured to engage the needle valve body and the receptacle, respectively.

9. A carburetor fuel mixture adjustment assembly for adjusting the air-fuel ratio of a fuel mixture to be supplied to an engine, the assembly comprising:

an interiorly threaded cylindrical needle valve receptacle formed in a carburetor main body, the valve receptacle intersecting a fuel passage formed in the carburetor main body;

a needle valve body supported within the needle valve receptacle and including an exteriorly threaded portion, a needle and a shank portion disposed between the threaded portion and the needle, the threaded portion of the valve body being in threaded engagement with the needle valve receptacle, the needle being disposable within an axially-aligned needle seat orifice portion of the fuel passage and being axially advanceable and retractable, by rotation of the needle valve body within the needle valve body receptacle, to positions relative to the needle seat orifice to respectively decrease and increase the size of a portion of the orifice open to fuel flow;

a valve spring concentrically disposed around the needle valve body between a head of the needle valve body and the carburetor main body in a position biasing the head axially away from the carburetor main body;

a needle stabilizer engaging and cooperating with the valve spring in laterally biasing the needle into one position relative to the needle seat orifice to assure constant fuel flow through the orifice by resisting needle displacement due to such factors as engine vibration and installation of a tamper-resistant limiter cap on an outer end of the needle; and the needle stabilizer comprises at least one wedge having an axially-inwardly directed leading edge engaged between the needle valve body and the valve body receptacle and a bearing surface disposed axially opposite the leading edge and operatively engaging the spring such that the spring biases the wedge axially inward.

10. A carburetor fuel mixture adjustment assembly as defined in claim 9 in which the wedge is an annular wedge ring concentrically disposed around the needle valve body.

11. A carburetor fuel mixture adjustment assembly as defined in claim 10 in which the needle stabilizer comprises a complementary-shaped wedge ring receptacle formed in the carburetor main body and configured to axially receive the wedge ring.

12. A carburetor fuel mixture adjustment assembly as defined in claim 9 in which the needle stabilizer additionally includes a ramped surface disposed on a spring seat disposed between the valve spring and the carburetor main body in a position biasing the spring against the needle valve body.

13. A carburetor fuel mixture adjustment assembly as defined in claim 9 in which an annular sealing member is concentrically disposed between the shank portion of the needle valve body and the needle valve body receptacle and is compressed between the receptacle and the shank.

14. A carburetor fuel mixture adjustment assembly as defined in claim 13 in which the annular sealing member has a generally conical shape including independent annular expansion and compression regions disposed adjacent respective axially opposite ends of the sealing member and configured to engage the needle valve body and the receptacle, respectively.

15. A carburetor fuel mixture adjustment assembly for adjusting the air-fuel ratio of a fuel mixture to be supplied to an engine, the assembly comprising:

an interiorly threaded cylindrical needle valve receptacle formed in a carburetor main body, the valve receptacle intersecting a fuel passage formed in the carburetor main body;

a needle valve body supported within the needle valve receptacle and including an exteriorly threaded portion, a needle and a shank portion disposed between the threaded portion and the needle, the threaded portion of the valve body being in threaded engagement with the needle valve receptacle, the needle being disposable within an axially-aligned needle seat orifice portion of the fuel passage and being axially advanceable and retractable, by rotation of the needle valve body within the needle valve body receptacle, to positions relative to the needle seat orifice to respectively decrease and increase the size of a portion of the orifice open to fuel flow;

a valve spring concentrically disposed around the needle valve body between a head of the needle valve body and the carburetor main body in a position biasing the head axially away from the carburetor main body;

a needle stabilizer configured to engage and cooperate with the valve spring in laterally biasing the needle into one position relative to the needle seat orifice to assure constant fuel flow through the orifice by resisting needle displacement due to such factors as engine vibration and installation of a tamper-resistant limiter cap on an outer end of the needle; and an annular sealing member concentrically disposed between the shank portion of the needle valve body and the needle valve body receptacle and compressed between the receptacle and the shank, the annular sealing member having a generally conical shape including independent annular expansion and compression regions disposed adjacent respective axially opposite ends of the sealing member and configured to engage the needle valve body and the receptacle, respectively and configured to provide a seal between the valve body and the valve receptacle despite rough machining tolerances and any concentricity mismatch between the shank and receptacle.

16. A carburetor fuel mixture adjustment assembly as defined in claim 15 in which the annular expansion region is disposed at an axial inner end of the sealing member and is configured to expand slightly when installed around the shank; and the annular compression region is disposed at an axial outer end of the sealing member opposite the inner end and is configured to compress when seated in the valve body receptacle.

17. A carburetor fuel mixture adjustment assembly as defined in claim 16 in which the annular expansion region of the sealing member has an inner circumferential contact area; and the annular compression region has an outer circumferential contact area greater than the inner contact area of the annular expansion region.

18. A carburetor fuel mixture adjustment assembly as defined in claim 17 in which the amount of interference between the shank and the annular expansion region of the sealing member is calibrated to prevent excessive drag on the shank.

* * * * *